US010494818B2

(12) United States Patent
Maziarz

(10) Patent No.: US 10,494,818 B2
(45) Date of Patent: Dec. 3, 2019

(54) VENTED STOP BEAD APPARATUS, VENTED WEEP SCREED APPARATUS, AND RELATED SYSTEMS AND METHODS THEREOF

(71) Applicant: E-Z BEAD, LLC, Royersford, PA (US)

(72) Inventor: Jeffrey Maziarz, Royersford, PA (US)

(73) Assignee: E-Z BEAD, LLC, Royersford, PA (US)

( * ) Notice: Subject to any disclaimer, the term of this patent is extended or adjusted under 35 U.S.C. 154(b) by 0 days.

(21) Appl. No.: 15/791,246

(22) Filed: Oct. 23, 2017

(65) Prior Publication Data

US 2018/0112414 A1 Apr. 26, 2018

Related U.S. Application Data

(60) Provisional application No. 62/412,710, filed on Oct. 25, 2016, provisional application No. 62/443,405,
(Continued)

(51) Int. Cl.
*E04F 13/04* (2006.01)
*E04F 19/06* (2006.01)
(Continued)

(52) U.S. Cl.
CPC ..... *E04F 13/045* (2013.01); *E04F 13/06* (2013.01); *E04F 13/068* (2013.01);
(Continued)

(58) Field of Classification Search
CPC ..... E04F 13/045; E04F 13/06; E04F 13/068; E06B 1/62; E06B 7/2303; E06B 2001/624; E06B 1/02
See application file for complete search history.

(56) References Cited

U.S. PATENT DOCUMENTS 517,701 A 4/1894 Knower
1,030,044 A 6/1912 Whittbecker
(Continued)

FOREIGN PATENT DOCUMENTS

DE 2455775 8/1976 ..... E04F 15/14
DE 2538412 3/1977 ..... E04F 15/14
(Continued)

OTHER PUBLICATIONS

Office Action issued in U.S. Appl. No. 14/869,524, undated, 11 pages.
(Continued)

*Primary Examiner* — Basil S Katcheves
*Assistant Examiner* — Omar F Hijaz
(74) *Attorney, Agent, or Firm* — Hayes Soloway P.C.

(57) ABSTRACT

A vented stop bead and a vented weep screed are used to vent a stucco or plaster wall. The vented stop bead has a base panel with a stop bead wall extending from the base panel at a first location and a spacing member wall extending from the base panel at a second location, wherein a spacing member is connected to the spacing member wall. A vented portion is positioned between the stop bead wall and the spacing member wall, wherein the vented portion has a venting structure positioned through the base panel between the first and second locations. The vented weep screed has a nailing fin with a first leg extending therefrom at a first location. A second leg extends from the nailing fin at a second location, the second leg having at least one venting structure positioned through the second leg.

19 Claims, 10 Drawing Sheets

Related U.S. Application Data filed on Jan. 6, 2017, provisional application No. 62/472,297, filed on Mar. 16, 2017.

(51) Int. Cl.

| | |
|---|---|
| ***E04F 13/06*** | (2006.01) |
| ***E06B 1/62*** | (2006.01) |
| ***E06B 7/23*** | (2006.01) |
| ***E06B 1/02*** | (2006.01) |

(52) U.S. Cl.

CPC ..... *E04F 19/061* (2013.01); *E06B 1/62* (2013.01); *E06B 7/2303* (2013.01); *E06B 1/02* (2013.01); *E06B 2001/624* (2013.01)

(56) References Cited

U.S. PATENT DOCUMENTS 1,361,843 A 12/1920 Flagge
1,386,509 A 8/1921 Kirmes
1,673,971 A 6/1928 Dowell
1,679,914 A 8/1928 Murray
1,840,221 A 1/1932 Bridges
1,886,320 A 11/1932 Waite
1,956,809 A 5/1934 Robertson
2,031,249 A 2/1936 Bowman
2,151,605 A 3/1939 Layering
2,189,216 A 2/1940 Mathias
2,198,084 A 4/1940 Jacobson
2,272,162 A 2/1942 Lackey
2,286,890 A 6/1942 Birt
2,405,844 A 8/1946 Mortenson
2,645,824 A * 7/1953 Titsworth ..... E04B 1/7069 220/592.01
2,725,608 A 12/1955 Parslow
2,732,045 A 1/1956 Herlocker
2,742,120 A 4/1956 Rosebrook
2,845,666 A 8/1958 Knapp
RE24,658 E 6/1959 Hollister
2,904,992 A 9/1959 Cruser
2,953,835 A 9/1960 Armstrong
3,192,577 A 7/1965 Barr
3,201,908 A 8/1965 Arnold
3,213,577 A 10/1965 Levin
3,314,201 A 4/1967 Riegelman
3,319,384 A 5/1967 Berg
3,320,707 A 5/1967 Berg ..... E04D 3/366
3,343,323 A * 9/1967 Mayfield ..... E04B 1/7076 454/254
3,344,720 A 10/1967 Hallock ..... E01D 19/06
3,349,519 A 10/1967 Nehlig
3,398,494 A 8/1968 Larson
3,421,267 A 1/1969 Reiff ..... E04D 13/1415
3,425,172 A 2/1969 Attaway ..... E04D 13/1415
3,486,283 A 12/1969 Arnett
3,509,674 A 5/1970 Birum, Jr.
3,512,318 A 5/1970 Turner
3,608,254 A 9/1971 Sklamberg
3,619,944 A 11/1971 Matvey
3,638,372 A 2/1972 Rosenthal ..... 52/97
3,667,174 A 6/1972 Arnett
3,670,470 A 6/1972 Thom ..... E04D 13/151
3,765,138 A 10/1973 Bentle
3,782,680 A 1/1974 Hopkins
3,813,180 A 5/1974 O'Brill
3,849,958 A 11/1974 Balzer ..... E04B 1/6804
3,871,787 A 3/1975 Stegmeier
3,922,826 A 12/1975 Molyneux
3,964,220 A 6/1976 Rutkowski
3,974,609 A 8/1976 Attaway ..... E04B 1/6804
4,038,791 A 8/1977 Atkinson
4,111,583 A 9/1978 Brady ..... E01D 19/06
4,271,650 A 6/1981 Lynn-Jones ..... E04B 1/6804
4,295,315 A 10/1981 Lynn-Jones ..... E04B 1/6804
4,359,847 A 11/1982 Schukolinski ..... E04B 1/6804
4,505,079 A 3/1985 Black
4,545,162 A 10/1985 Attaway
4,651,488 A 3/1987 Nicholas
4,663,883 A 5/1987 Hilliard
4,726,148 A 2/1988 Tix
4,763,455 A 8/1988 Schneller
4,774,795 A 10/1988 Braun
4,781,004 A 11/1988 Hartman
4,784,516 A 11/1988 Cox
4,785,601 A 11/1988 Tupman
4,829,731 A 5/1989 Schluter
4,833,851 A 5/1989 Ohmatsu ..... E04B 1/6804
4,841,704 A 6/1989 Jarrell
4,984,402 A 1/1991 Davies ..... 52/398
5,014,471 A 5/1991 Ballstadt
5,042,211 A 8/1991 Nestler
5,073,430 A 12/1991 Aidan
5,127,204 A 7/1992 Braun
5,181,357 A 1/1993 Pourtau
5,210,986 A 5/1993 Hagemeyer
5,222,343 A 6/1993 Anderson
5,230,738 A 7/1993 Wheeler
5,305,566 A 4/1994 Larkowski
5,313,755 A 5/1994 Koenig, Jr.
5,333,432 A 8/1994 Schluter
5,338,130 A 8/1994 Baerveldt
5,365,713 A 11/1994 Nicholas ..... E04B 1/681
5,384,996 A 1/1995 Nicholas ..... E04B 1/681
5,406,758 A * 4/1995 Baum ..... E02B 11/005 249/6
5,423,154 A 6/1995 Maylon
5,430,981 A 7/1995 Scott
5,450,699 A 9/1995 Lee
D364,233 S 11/1995 Caley
5,519,969 A 5/1996 Golba ..... 52/60
5,544,445 A 8/1996 Mantilla
5,551,201 A 9/1996 Anderson
5,560,166 A 10/1996 Burke ..... F16J 15/065
5,575,126 A 11/1996 Attaway ..... E04B 1/6804
5,579,623 A 12/1996 Stark
5,607,253 A 3/1997 Almstrom
5,671,571 A 9/1997 Braun
5,694,723 A * 12/1997 Parker ..... E02D 27/32 404/4
5,699,638 A 12/1997 Maylon
5,761,866 A 6/1998 Maylon
5,790,671 A 8/1998 Cooper
5,791,111 A 8/1998 Beenders ..... E04B 1/6804
5,791,116 A 8/1998 Skintzis
5,836,135 A * 11/1998 Hagan ..... E04B 1/762 52/836
5,946,870 A 9/1999 Bifano et al. ..... 52/254
5,950,370 A 9/1999 Peck
5,970,671 A 10/1999 Bifano et al. ..... 52/254
6,018,924 A 2/2000 Tamlyn
6,052,959 A * 4/2000 LaBrosse ..... E04B 1/7076 248/48.1
6,102,407 A 8/2000 Moriya et al.
6,119,416 A 9/2000 Larson
6,122,883 A 9/2000 Braun
6,131,352 A 10/2000 Barnes ..... E04B 1/948
6,223,486 B1 5/2001 Dunham
6,293,064 B1 * 9/2001 Larson ..... E04B 1/762 52/209
6,298,609 B1 * 10/2001 Bifano ..... E04B 1/765 52/101
6,308,475 B1 10/2001 Crish, II
6,322,045 B1 11/2001 Andros
6,338,229 B1 1/2002 Botzen
D456,528 S 4/2002 Maylon
6,367,210 B1 4/2002 Trundle
6,385,932 B1 * 5/2002 Melchiori ..... E04F 13/06 52/302.3
6,425,216 B1 7/2002 Gardner
6,490,831 B1 12/2002 Candusso
D471,991 S 3/2003 Maylon
6,527,467 B2 3/2003 Betts ..... E01D 19/065

(56) References Cited

U.S. PATENT DOCUMENTS

| | | | | |
|---|---|---|---|---|
| 6,598,360 | B1 * | 7/2003 | Pratt | E02D 31/02 52/169.5 |
| 6,631,595 | B1 | 10/2003 | Minter | |
| 6,705,047 | B2 | 3/2004 | Yulkowski | |
| 7,406,805 | B1 | 8/2008 | Larson | |
| 7,458,190 | B2 | 12/2008 | Isaac et al. | |
| 7,526,897 | B2 | 5/2009 | Collins | |
| 7,634,883 | B1 | 12/2009 | Larson et al. | 52/573.1 |
| 7,874,123 | B2 | 1/2011 | Maziarz | 52/741.4 |
| 8,132,380 | B2 | 3/2012 | Wilkes, Jr. | |
| 8,561,367 | B2 * | 10/2013 | Kelly | E04D 3/405 52/198 |
| 8,578,660 | B2 | 11/2013 | Nolan et al. | 52/62 |
| 8,615,944 | B2 | 12/2013 | Maziarz | 52/273 |
| 8,646,235 | B2 | 2/2014 | Hilburn | E04B 1/948 |
| 8,919,062 | B1 | 12/2014 | Viness et al. | 52/302.3 |
| 9,062,453 | B1 | 6/2015 | Maziarz | E04B 1/68 |
| 9,238,897 | B2 | 1/2016 | Nolan et al. | E02D 31/02 |
| 9,279,247 | B2 | 3/2016 | Maziarz | E04F 1/66 |
| D762,310 | S | 7/2016 | Apanovich | |
| 9,797,142 | B1 * | 10/2017 | Sacks | E04F 13/04 |
| 10,196,812 | B1 * | 2/2019 | Duffy | E04F 13/07 |
| 2002/0124504 | A1 | 9/2002 | Maylon | |
| 2003/0051422 | A1 | 3/2003 | Maziarz | |
| 2004/0020143 | A1 | 2/2004 | Webb | |
| 2004/0216414 | A1 | 11/2004 | Dickinson | 52/506.01 |
| 2005/0204653 | A1 * | 9/2005 | Matthews | E02D 31/02 52/169.5 |
| 2006/0005472 | A1 * | 1/2006 | Miller | E06B 7/18 49/498.1 |
| 2006/0150553 | A1 | 7/2006 | Reyes et al. | E04F 13/06 |
| 2007/0062137 | A1 | 3/2007 | Maylon | 52/367 |
| 2008/0263971 | A1 | 10/2008 | Maziarz | 52/204.1 |
| 2009/0183453 | A1 * | 7/2009 | Koessler | E04F 13/007 52/302.3 |
| 2010/0257799 | A1 * | 10/2010 | Johnson | E04F 13/0864 52/302.1 |
| 2011/0277394 | A1 * | 11/2011 | Chich | E04D 13/152 52/95 |
| 2012/0174495 | A1 * | 7/2012 | Nolan | E04F 19/045 52/58 |
| 2014/0245676 | A1 | 9/2014 | Maziarz | E06B 1/62 |
| 2016/0069071 | A1 | 3/2016 | Remmele | E04B 2/02 |
| 2016/0186481 | A1 | 6/2016 | Maziarz | E06B 1/02 |
| 2017/0130462 | A1 | 5/2017 | Maziarz | E04F 13/06 |

FOREIGN PATENT DOCUMENTS

| | | | |
|---|---|---|---|
| DE | 3503395 | 8/1986 | E04B 1/68 |
| FR | 2307091 | 11/1976 | |
| FR | 2412236 | 7/1979 | |
| FR | 2507227 | 12/1982 | E04B 1/68 |
| SU | 1705521 | 1/1992 | |

OTHER PUBLICATIONS

U.S. Appl. No. 14/869,524 (unpublished).

Notice of Allowance issued in U.S. Appl. No. 11/981,421, dated Sep. 8, 2010 (6 pgs).

Notice of Allowance issued in U.S. Appl. No. 12/152,046, dated Feb. 12, 2014 (16 pgs).

Notice of Allowance issued in U.S. Appl. No. 12/931,079, dated Aug. 21, 2013 (11 pgs).

Notice of Allowance issued in U.S. Appl. No. 14/275,757, dated Jan. 29, 2016 (5 pgs).

Office Action issued in U.S. Appl. No. 09/952,920, dated Jan. 22, 2003 (12 pgs).

Office Action issued in U.S. Appl. No. 09/952,920, dated Jan. 26, 2005 (9 pgs).

Office Action issued in U.S. Appl. No. 09/952,920, dated Jun. 22, 2004 (6 pgs).

Office Action issued in U.S. Appl. No. 09/952,920, dated Oct. 22, 2003 (7 pgs).

Office Action issued in U.S. Appl. No. 11/259,499, dated Aug. 28, 2008 (9 pgs).

Office Action issued in U.S. Appl. No. 11/259,499, dated Oct. 23, 2007 (6 pgs).

Office Action issued in U.S. Appl. No. 11/259,499, dated Sep. 7, 2006 (9 pgs).

Office Action issued in U.S. Appl. No. 11/981,421, dated Aug. 5, 2009 (6 pgs).

Office Action issued in U.S. Appl. No. 12/152,046, dated Feb. 28, 2011 (7 pgs).

Office Action issued in U.S. Appl. No. 12/152,046, dated Nov. 30, 2011 (6 pgs).

Office Action issued in U.S. Appl. No. 12/152,046, dated Nov. 2, 2012 (28 pgs).

Office Action issued in U.S. Appl. No. 12/931,079, dated Oct. 15, 2012 (29 pgs).

Office Action issued in U.S. Appl. No. 12/931,079, dated Sep. 23, 2011 (11 pgs).

Office Action issued in U.S. Appl. No. 14/275,721, dated Jul. 13, 2015 (8 pgs).

Office Action issued in U.S. Appl. No. 14/275,721, dated Sep. 29, 2014 (9 pgs).

Office Action issued in U.S. Appl. No. 14/275,757, dated Jul. 14, 2015 (8 pgs).

Office Action issued in U.S. Appl. No. 14/275,757, dated Sep. 29, 2014 (9 pgs).

Office Action issued in U.S. Appl. No. 15/062,876, dated Oct. 19, 2016 (17 pgs).

Office Action issued in U.S. Appl. No. 15/865,952, dated Oct. 11, 2018 (10 pgs).

Office Action issued in U.S. Appl. No. 15/865,952, dated Mar. 1, 2019 (8 pgs).

U.S. Appl. No. 15/865,952, filed Jan. 9, 2018, Maziarz.

U.S. Appl. No. 15/865,952, filed Jan. 9, 2018.

U.S. Appl. No. 16/137,340, filed Sep. 20, 2018, Maziarz.

Office Action issued in U.S. Appl. No. 16/137,340 dated Aug. 6, 2019 (35 pgs).

Notice of Allowance issued in U.S. Appl. No. 15/865,952 dated May 30, 2019 (4 pgs).

* cited by examiner

VENTED STOP BEAD APPARATUS, VENTED WEEP SCREED APPARATUS, AND RELATED SYSTEMS AND METHODS THEREOF

CROSS REFERENCE TO RELATED APPLICATION

This application claims benefit of U.S. Provisional Application Ser. No. 62/412,710 entitled, "Vented stop bead apparatus, vented weep screed apparatus, and related systems and methods thereof" filed Oct. 25, 2016, U.S. Provisional Application Ser. No. 62/443,405 entitled, "Vented stop bead apparatus, vented weep screed apparatus, and related systems and methods thereof" filed Jan. 6, 2017, and U.S. Provisional Application Ser. No. 62/472,297 entitled, "Vented stop bead apparatus, vented weep screed apparatus, and related systems and methods thereof" filed Mar. 16, 2017, the entire disclosures of which are incorporated herein by reference.

FIELD OF THE DISCLOSURE

The present disclosure is generally related to casing beads and weep screeds, and more particularly is related to vented stop bead apparatuses, vented weep screed apparatuses, and related systems and methods thereof.

BACKGROUND OF THE DISCLOSURE

Stucco and/or plaster are typically used for both interior and exterior surfaces in home or commercial building construction. Stucco or plaster is routinely applied to a galvanized wire mesh over felt paper which has been attached to underlying plywood or other sheathing material. In order to provide a smooth edge where the stucco or plaster meets a door or window jamb or frame, plastic stop strips are installed along the desired edge of the stucco or plaster to contain it and provide for an even finish.

The plastic stop often used for this purpose generally consists of a perforated plastic strip approximately 2 inches wide with a plastic lip or edge acting to contain the stucco or plaster away from the jamb or frame. The plaster stop is typically installed approximately ¼ inch away from the jamb or frame, leaving a gap between the stop and the backing surface. In order to provide a complete finish, the worker must install a backer rod into the gap and then apply a finishing layer of caulk. This process that is used by some builders to prevent leaks is very time consuming.

This method of stucco installation has often resulted in leaking problems between the stucco or plaster surface and the adjacent jamb, thereby causing significant additional repair costs and frustration to both home owners and construction companies. In addition, the extra time and materials necessary for installation of the backer rod and finishing caulk layer can add considerably to the costs and duration of the construction.

Additionally, weep screeds are used with stucco or plaster walls towards a bottom edge of the wall to act as a stop for the stucco or plaster applied to the wall. Weep screeds generally have a face that abuts the wall and a single shelf that extends laterally outwards to provide a surface for the stucco or plaster to contact. The weep screed also allows moisture to be relieved from the stucco or plaster by allowing any moisture that drains down the back side of the rainscreen to vent out through the weep screed.

However, even with products designed to allow venting of moisture from stucco or plaster walls, these walls still have moisture and venting problems. Thus, a heretofore unaddressed need exists in the industry to address the aforementioned deficiencies and inadequacies.

SUMMARY OF THE DISCLOSURE

Embodiments of the present disclosure provide a system and method for a vented stop bead apparatus. Briefly described, in architecture, one embodiment of the apparatus, among others, can be implemented as follows. The vented stop bead apparatus has a base panel. A stop bead wall extends from the base panel at a first location. A spacing member wall extends from the base panel at a second location, wherein a spacing member is connected to the spacing member wall. A vented portion is positioned between the stop bead wall and the spacing member wall, wherein the vented portion has at least one venting structure positioned through the base panel in a position between the first and second locations.

The present disclosure can also be viewed as providing a system and method for a vented weep screed apparatus. Briefly described, in architecture, one embodiment of the apparatus, among others, can be implemented as follows. A vented weep screed apparatus has a nailing fin. A first leg extends from the nailing fin at a first location. A second leg extends from the nailing fin at a second location, the second leg having at least one venting structure positioned through the second leg.

The present disclosure can also be viewed as providing a system for venting a wall formed of at least one of stucco and plaster wall. Briefly described, in architecture, one embodiment of the system, among others, can be implemented as follows. A vented weep screed is positioned proximate to a bottom edge of the wall and connected to a wall backer, the vented weep screed having at least one venting structure positioned through a leg thereof. A vented stop bead is connected to the wall backer, the vented stop bead having at least one venting structure positioned therethrough. A rain screen is positioned between the vented stop bead and the wall backer, wherein the rainscreen extends along the wall backer between the vented stop bead and the vented weep screed, wherein a venting path is created from the at least one venting structure of the vented stop bead, through the rain screen, and through the at least one venting structure of the vented weep screed.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
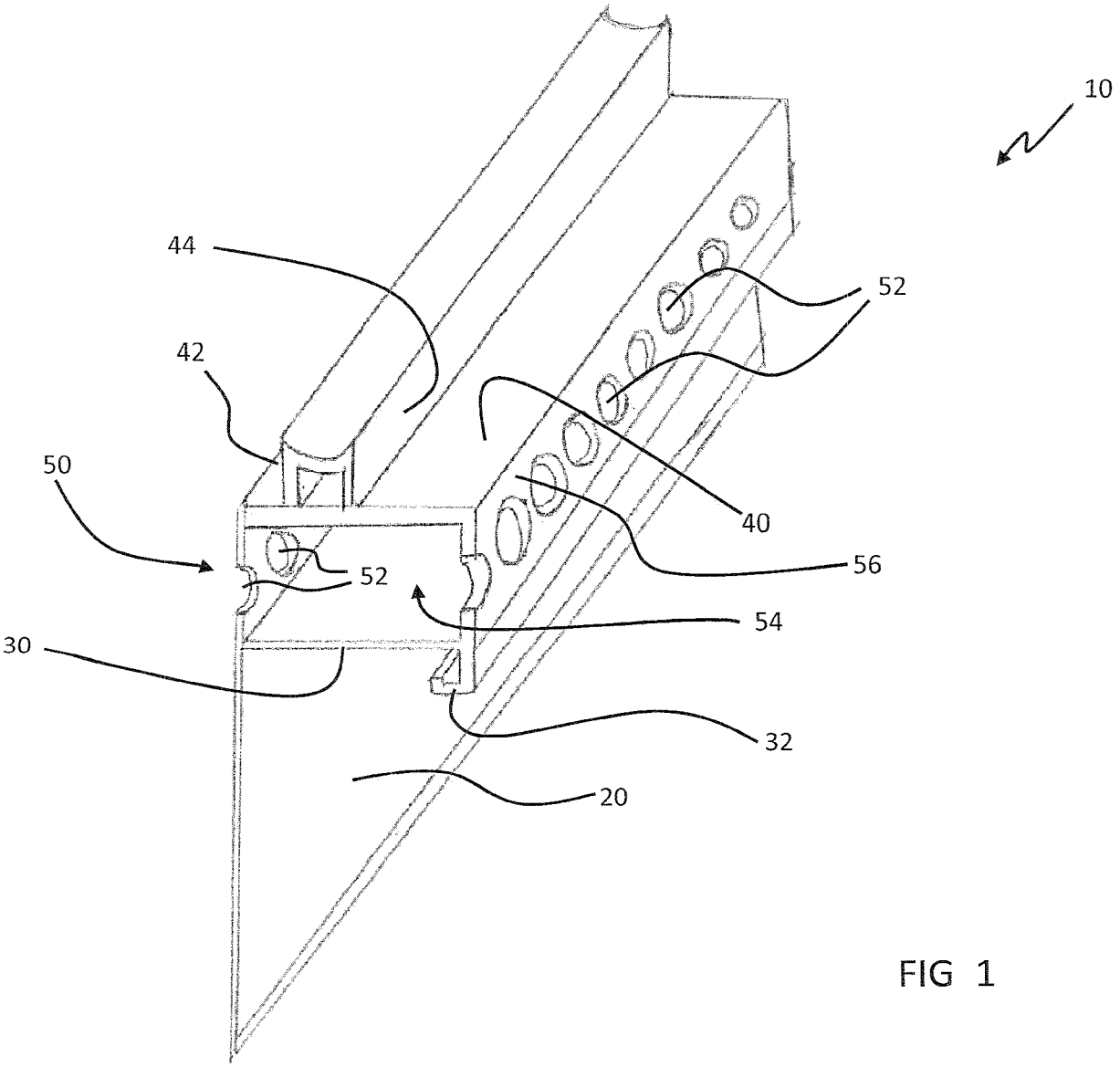
FIG. 1 is an elevated, side-view, cross-sectional illustration of a vented stop bead apparatus, in accordance with a first exemplary embodiment of the present disclosure.

FIG. 1 is an elevated, side-view, cross-sectional illustration of a vented stop bead apparatus 10, in accordance with a first exemplary embodiment of the present disclosure. The vented stop bead apparatus 10, which may be referred to herein simply as 'apparatus 10' or as 'casing bead apparatus', has a base panel 20. A stop bead wall 30 extends from the base panel 20 at a first location. A spacing member wall 40 extends from the base panel 20 at a second location. A spacing member 42 is connected to the spacing member wall 40. A vented portion 50 is positioned between the stop bead wall 30 and the spacing member wall 40, wherein the vented portion 50 has at least one venting structure 52 positioned through the base panel 20 in a position between the first and second locations.

Conventionally, leaking and other problems often occur where the stucco or plaster finish aligns with other design constructs of the home or building, such as windows or doors. Stop strips which contain and form the outer boundaries of the stucco or plaster surfaces where they meet window or door jambs have been developed to improve the seal and finishes of these adjacencies. In place of stop strips, the vented stop bead apparatus 10 may significantly reduce the time and costs necessary to install smooth finishes where stucco or plaster meets window or door frames or jamb. In ordinary house of building construction, exterior and interior surfaces are often made of stucco or plaster. The method of installation of these materials is generally consistent in the construction business and usually involves the installation of a felt layer over the backing wall (plywood or similar material), a galvanized wire (or lathe) layer, and both scratch and finish coats of stucco or plaster. Other materials or layers of materials may also be included within the wall construction, including a vapor barrier and a rainscreen.

The base panel 20 of the apparatus 10, which may be referred to as a nailing fin, may have a rear face which is applied next to a backing or nailing structure, such as plywood or particle board placed over framing studs, and a front face which faces away from the backing or nailing structure over which plaster or stucco material is applied after the apparatus 10 is mounted adjacent to the jamb. The base panel 20 may have perforations, holes, or other structures formed therein. The stop bead wall 30 extends from the base panel 20 at a first location along the base panel 20. The stop bead wall 30 may extend substantially perpendicularly from the base panel 20, or at other angular orientations, such that it is extended from the front face of the base panel 20 a predetermined distance. One side of the stop bead wall 30 may engage the stucco or plaster material applied to the front face of the base panel 20. At a distal end of the stop bead wall 30, an engaging structure 32 may be positioned, which may include a turned-back hook protrusion which creates a lip for the stucco or plaster material to contact.

At a location along the base panel 20 that differs from the location of the stop bead wall 30, the spacing member wall 40 extends from the front face of the base panel 20. The spacing member wall 40 may, in one example, be positioned substantially parallel to the stop bead wall 30. In one example, the spacing member wall 40 is positioned at a terminating end of the stop bead wall 20, as is shown in FIG. 1. The spacing member 42 formed on the spacing member wall 40 extends outwardly away from the spacing member wall 40 and the stop bead wall 30. The spacing member 42 may include a strip of flexible, resilient material, e.g., a plastic, metal, rubber, foam, or a polymer, such as flexible vinyl or a flexible exterior grade vinyl, which is capable of abutting a proximate jamb and providing a sealed connection to the jamb. The spacing member 42 may be integrally formed with the spacing member wall 40, such as by co-extrusion, or it may be a separate structure which is attached to the spacing member wall 40. For example, the spacing member 42 may include a foam or rubberized strip of material which is adhesively connected to the spacing member wall 40. As is shown in FIG. 1, the spacing member 42 may have a hollow section formed from various walls (the spacing member wall 40 being one of them), where the jamb-facing portion of the spacing member 42 has a concave design. A bond break tape 44, or similar component, may be positioned on a front face of the spacing member 42.

The vented portion 50 of the apparatus 10 is positioned between the stop bead wall 30 and the spacing member wall 40. The vented portion 50 has at least one venting structure 52 positioned through the base panel 20 in a position between the first and second locations, i.e., the locations of the stop bead wall 30 and the spacing member wall 40. In a simplistic design, for clarity, the venting portion 50 has venting structures 52, which may be holes or other protrusions, through the base panel 20, such that there can be fluid movement (gas, etc.) through the base panel 20 and to the rainscreen which is positioned behind the base panel 20 during wall construction with the apparatus 10. The venting protrusions 52 may extend along the length of the apparatus 10, or they may be positioned along specific portions of the apparatus 10.

The venting portion 50 may, in some examples, include a partially enclosed interior 54 which is formed between the venting structures 52 on the base panel 20 and venting structures 52 on a forward wall 56 of the venting portion 50. More specifically, the interior 54 may be formed between the venting structures 52 on the base panel 20, the forward wall 56, the stop bead wall 30, and the spacing member wall 40. The forward wall 56 may be positioned substantially parallel to the base panel 20 such that the interior 54 has a continuous cross section along the length of the apparatus 10. The venting structures 52 may have a variety of designs, shapes, and/or sizes. For example, the venting structures 52 may be circular holes or holes having another shape. They may also be perforated sections of the walls formed using a puncturing or die cutting process. The size of the venting structures 52 may vary, depending on design, but they may be small enough to prevent the entrance of insects or other pests, while still allowing for air and/or fluid movement. The venting portion 50 of the apparatus 10 may allow for venting of a stucco or plastered wall, all while maintaining a seal between the apparatus 10 (and stucco or plastered wall) and the abutting jamb of a window, door, or other structure, as is further described relative to FIGS. 3-4.

Figure 2B:
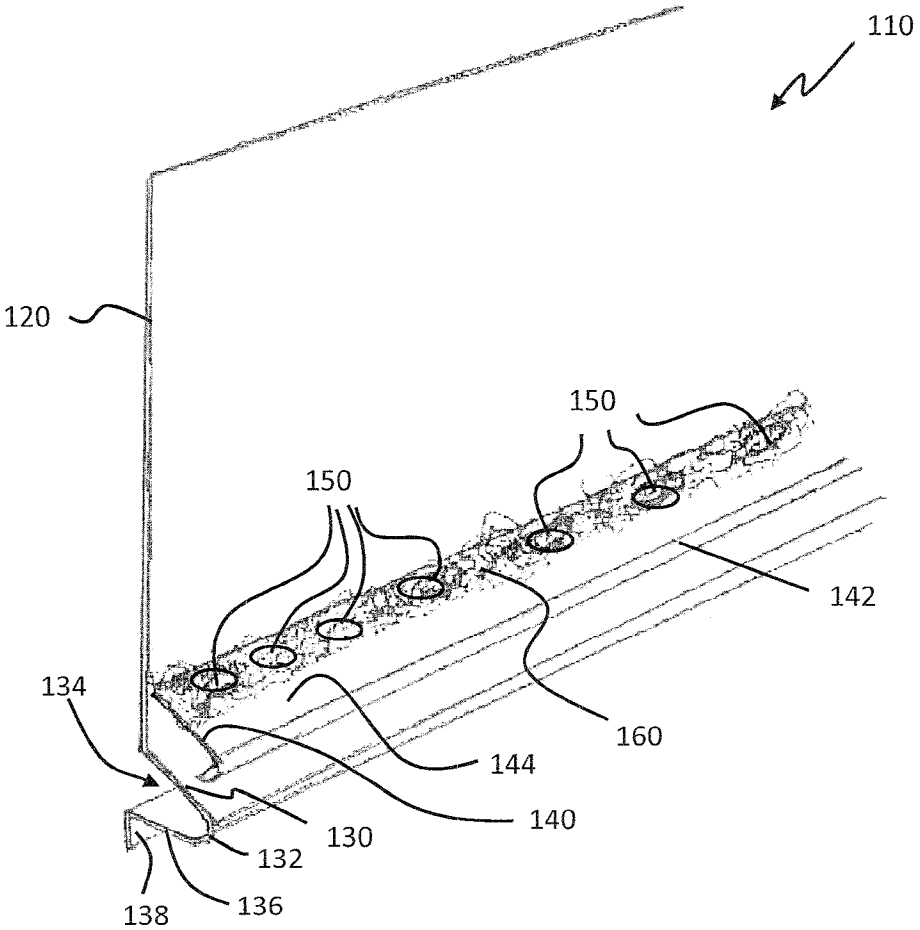
FIG. 2B is an elevated, side-view illustration of the vented weep screed apparatus, in accordance with the second exemplary embodiment of the present disclosure.
Figure 2A:
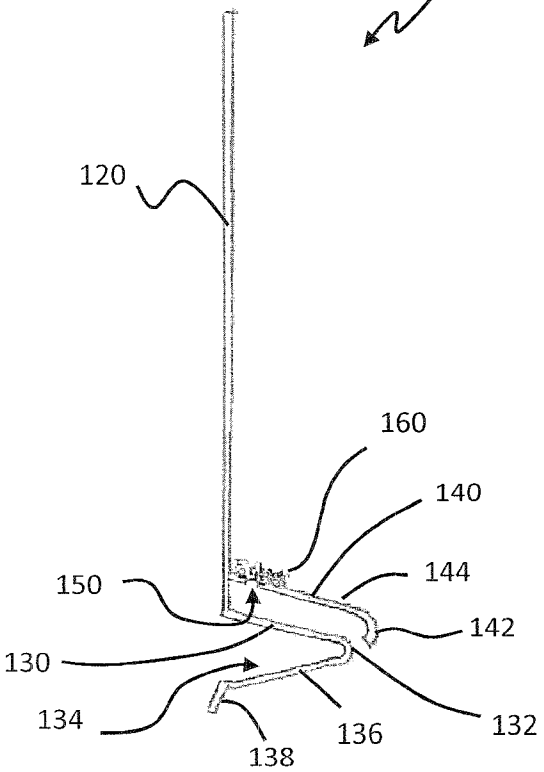
FIG. 2A is a side-view, cross-sectional illustration of a vented weep screed apparatus 110, in accordance with a second exemplary embodiment of the present disclosure.
Figure 2C:
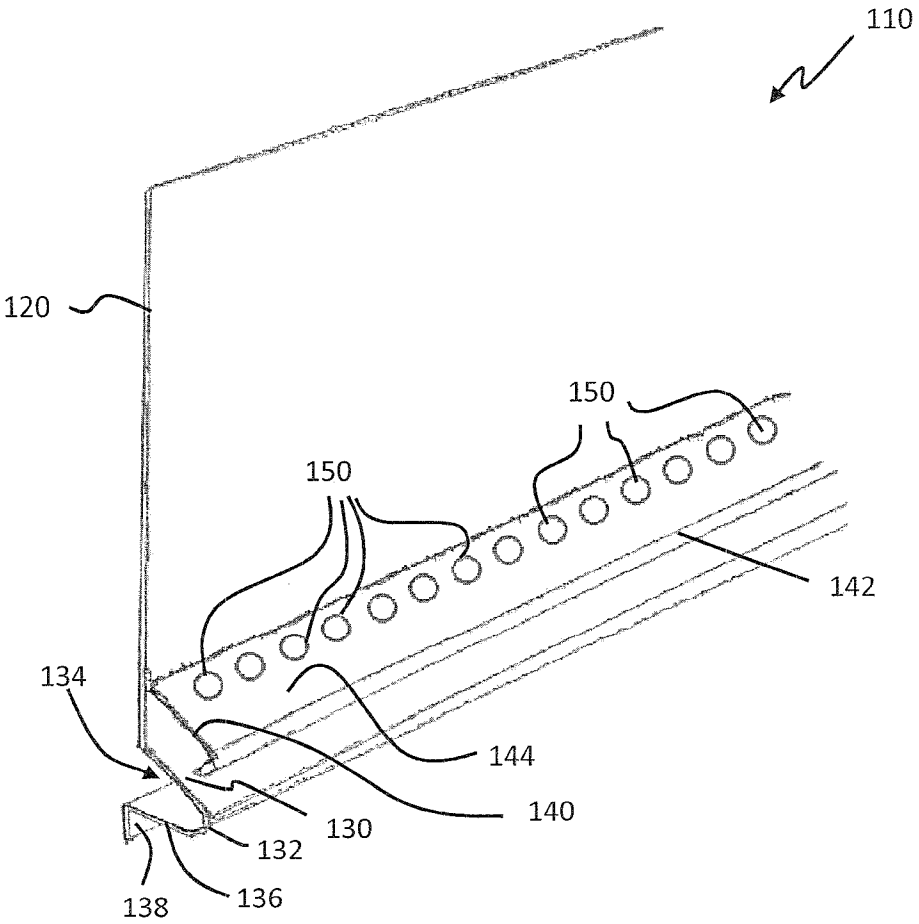
FIG. 2C is an elevated, side-view illustration of the vented weep screed apparatus without the screening material, in accordance with the second exemplary embodiment of the present disclosure.

FIG. 2A is a side-view, cross-sectional illustration of a vented weep screed apparatus 110, in accordance with a second exemplary embodiment of the present disclosure. FIG. 2B is an elevated, side-view illustration of the vented weep screed apparatus 110, in accordance with the second exemplary embodiment of the present disclosure. FIG. 2C is an elevated, side-view illustration of the vented weep screed apparatus 110 without the screening material 160 in accordance with the second exemplary embodiment of the present disclosure.

Relative to FIGS. 2A-2C, the vented weep screed apparatus 110, which may be referred to herein as 'apparatus 110' includes a nailing fin 120 having a front face and a rear face, where the rear face is applied next to a backing or nailing structure, such as plywood or particle board placed over framing studs, and the front face faces away from the backing or nailing structure over which plaster or stucco material is applied after the apparatus 110 is mounted to the wall. The nailing fin 120 may have perforations, holes, or other structures formed therein, such as for guiding nails or other fasteners when the apparatus 110 is applied to a wall. The apparatus 110 has at least a first leg 130 extending from the nailing fin 120 at a first location, and a second leg 140 extending from the nailing fin 120 at a second location. As is shown in FIGS. 2A-2C, the first leg 130 may be positioned towards a bottom, terminating portion of the nailing fin 120, and may include a curved edge 132 which extends back towards a plane of the nailing fin 120 with a reverse leg 134, where a cavity 136 is formed between the first leg 130 and the reverse leg 134. At the end of the reverse leg 134 may be a terminating leg 138 which may extend angularly from the reverse leg 134. Other designs, shapes, and features may be included with the first leg 130 or the associated structures therewith, all of which are considered within the scope of the present disclosure.

The second leg 140 extends from the nailing fin 120 at a location that is different from the first leg 130, such as with the second leg 140 spaced a distance above the first leg 130, as depicted in FIGS. 2A-2C. The second leg 140 may be positioned substantially parallel to the first leg 130 for a portion of the second leg 140, or it may extend in a non-parallel direction relative to the first leg 130. The second leg 140 may have a terminating curved portion 142 which is positioned proximate to the curved portion 132 of the first leg 130. The second leg 140 may have an upwards-facing surface 144, positioned oppositely-facing the first leg 130, which the at least one venting structure 150 is positioned on, such that the at least one venting structure 150 is positioned through the second leg 140. The venting structures 150 may be positioned on the second leg 140 in a position close to the nailing fin 120, but may also be spaced sufficiently from the nailing fin 120. FIG. 2C illustrates the apparatus 110 with the venting structures 150 depicted without the screening material 160 for clarity in disclosure. The specific location of the venting structures 150 on the second leg 140 may be depending on the wall construction (thickness of layers/materials used within the wall), and the design of the angle of the second leg 140 relative to the nailing fin 120. As shown, there may be a plurality of venting structures 150 positioned along the length of the apparatus 110. The venting structures 150 may have a variety of designs, shapes, and/or sizes. For example, the venting structures 150 may be circular holes or holes having another shape. They may also be perforated sections of the second leg 140 formed using a puncturing or die cutting process. The size of the venting structures 150 may vary, depending on design.

The at least one screening material 160 is positioned overlying the at least one venting structure 150 through the second leg 140. In one example, the screening material 160 is a mesh fabric or netting which can be secured to the second leg 140 over the venting structures 150. Other materials or types of structures may also be used as a screening material 160, including any natural or synthetic fiber-based material, or preformed perforated material, which is capable of allowing the egress of fluids (gas, liquids, etc.) through the venting structures 150 while preventing some particulate matter, such as stucco or plaster material, from moving through the venting structures 150, or particulate matter from moving through the venting structures 150 from the bottom of the second leg 140. For example, the screening material 160 may include a fibrous material which has a thickness that rises above the second leg 140, a flattened plastic or metal mesh screen which substantially lays on the surface of the second leg 140, or another type of screening material, such as a perforated material. The thickness, size, or location of the screening material 160 may vary by design. The venting portion 150 of the apparatus 110, in combination with the screening material 160, may allow for venting of the stucco or plastered wall through the apparatus 110 while preventing the stucco, plaster, or other construction materials from seeping or moving through the venting structures 150, as is further described relative to FIGS. 3-4.

Figure 3:
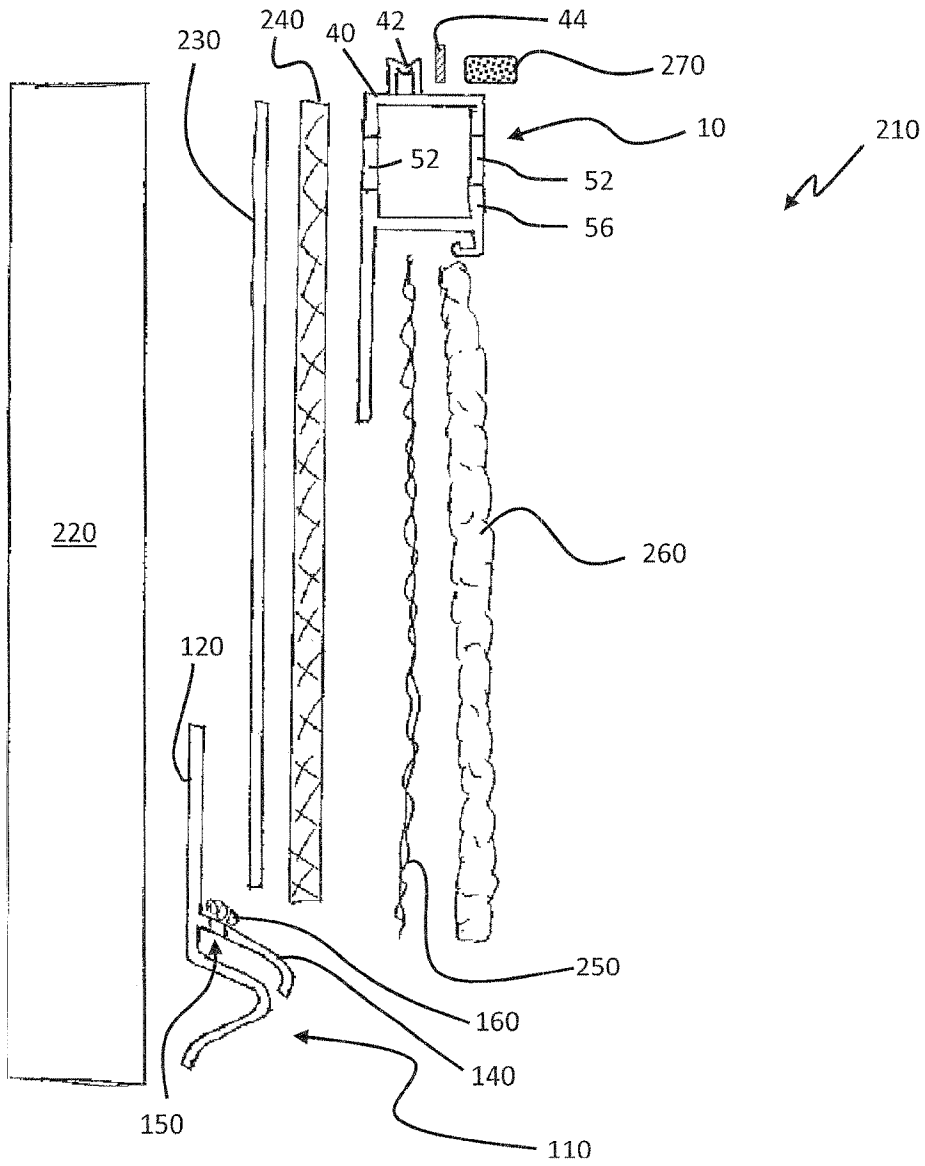
FIG. 3 is an exploded, side-view, cross-sectional illustration of the vented casing bead apparatus and the vented weep screed apparatus used in a system for venting a stucco or plaster wall, in accordance with a third exemplary embodiment of the present disclosure.
Figure 4:
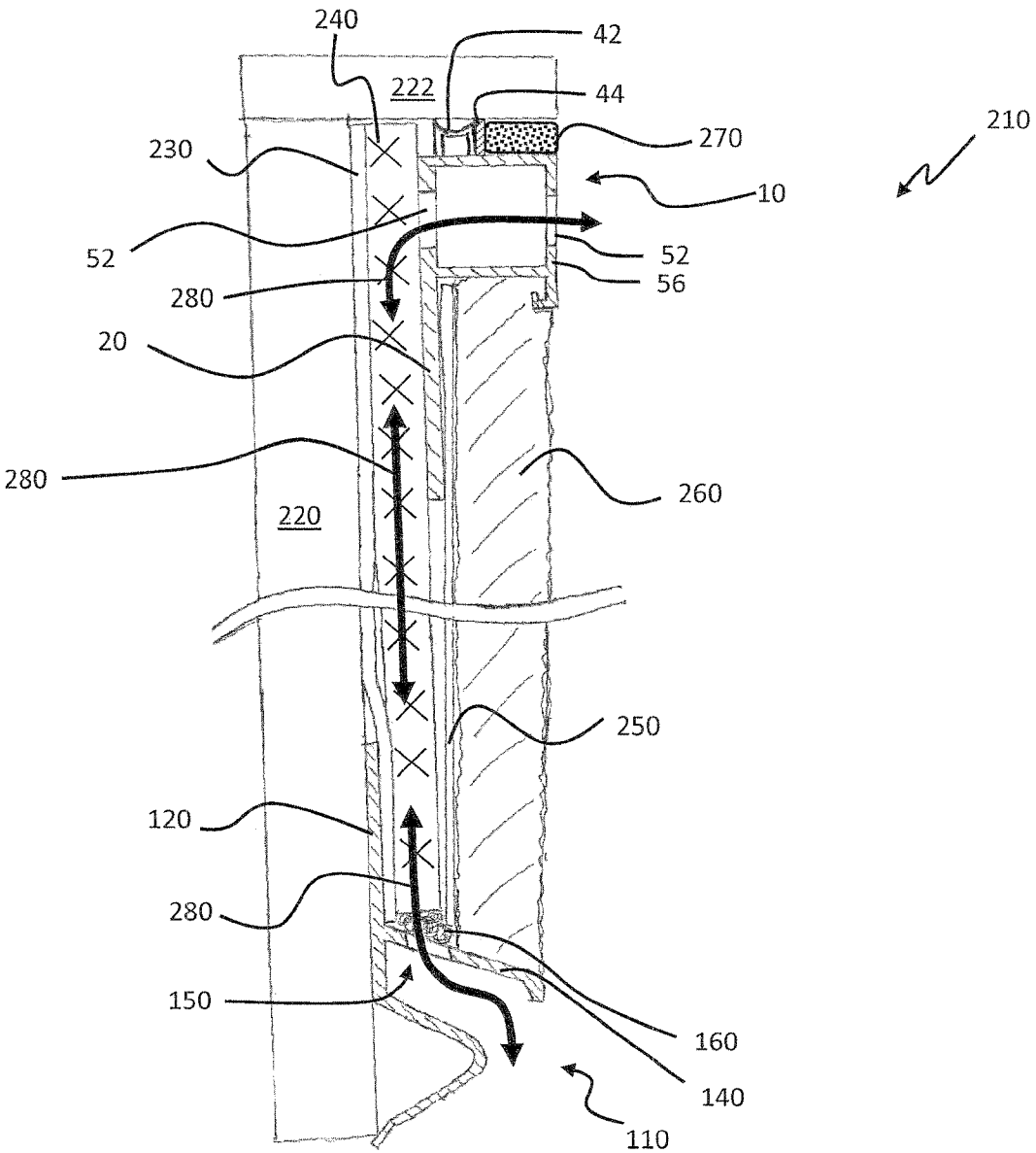
FIG. 4 is a side-view, cross-sectional illustration of the vented casing bead apparatus and the vented weep screed apparatus used in the system for venting a stucco or plaster wall, in accordance with a third exemplary embodiment of the present disclosure.

FIG. 3 is an exploded, side-view, cross-sectional illustration of the vented casing bead apparatus 10 and the vented weep screed apparatus 110 used in a system 210 for venting a stucco or plaster wall, in accordance with a third exemplary embodiment of the present disclosure. FIG. 4 is a side-view, cross-sectional illustration of the vented casing bead apparatus 10 and the vented weep screed apparatus 110 used in the system 210 for venting a stucco or plaster wall, in accordance with a third exemplary embodiment of the present disclosure. As shown, the system 210 may include the use of both the vented casing bead apparatus 10 and the vented weep screed apparatus 110, although it is noted that the two apparatuses 10, 110 may also be used independent of one another.

Relative to FIGS. 3-4, the system 210 includes a backer or nailing member 220 which may include the unfinished wall of a structure, e.g., a plywood wall anchored to wood or metal studs. The apparatus 110 may be positioned towards a bottom of the backer or nailing member 220 such that it is positioned towards the bottom of the wall. A vapor barrier 230 may be positioned over the backer or nailing member 220 and over the nailing fin 120 of the apparatus 110. Next, a rainscreen 240, which may also be known as a drainage mat, is positioned over the vapor barrier 230. The rainscreen 240 may provide a narrow cavity within the wall construction between the exterior cladding (stucco or plaster) and the main structure of the wall (backing or nailing member 220). The cavity created by the rainscreen 240 allows for free drainage of any water that may penetrate the stucco or plaster. The air space within the rainscreen 240 also promotes rapid drying of substrates and cladding materials, inhibiting moisture penetration into the building envelope. Further, the rainscreen 240 may ensure pressure equalization across the cavity to prevent water being drawn into the building itself.

Next, the vented casing bead apparatus 10 is positioned over the rainscreen 240 such that the venting structure 52 positioned through the base panel 20 of the apparatus 10 substantially contacts the rainscreen 240. Then, the stucco or plaster coats 260 are applied to a wire mesh 250, such as a galvanized wire mesh, which is secured to the base panel 20 of the apparatus 10 and the rainscreen 240. The coats of stucco or plaster 260 may be applied to the front edge of the apparatus 10, such that they are substantially aligned with the venting structures 52 on the forward wall 56 of the apparatus 10. Caulking 270 may be applied above the venting structures 52 in the cavity created between the spacing member wall 40 and the jamb 222 (FIG. 4), and abutting the bond break tape 44 positioned against the spacing member 42.

FIG. 4 depicts the system 210 using the vented casing bead apparatus 10 and the vented weep screed apparatus 110 with the components of the wall in locations similar to actual construction. As can be seen, a vent path 280 may be formed through the rainscreen 240 within the wall's construction. The vent path 280 may extend through the vented casing bead apparatus 10 by way of the venting structures 52 and it may extend through the screening material 160 and venting structure 150 of the vented weep screed apparatus 110. With this design, the system 210 may improve the venting of the wall by more easily allowing air movement through the internal construction of the wall and by allowing any moisture located within the wall to easily escape. Other benefits of the system 210, as well as of the vented casing bead apparatus 10 and the vented weep screed apparatus 110, will be recognizable to those skilled in the industry based on the disclosure herein, all of which are considered within the scope of the present disclosure.

Figure 5B:
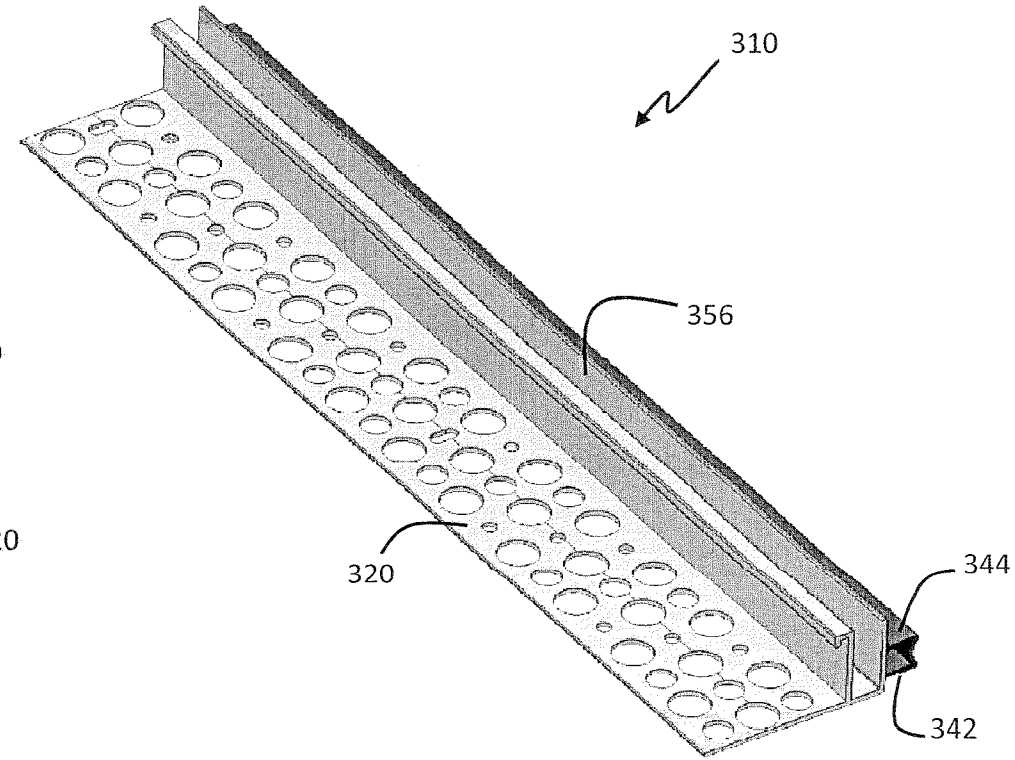
FIGS. 5A-5B are side view and isometric view illustrations of the vented stop bead apparatus, in accordance with a fourth exemplary embodiment of the present disclosure.
Figure 5A:
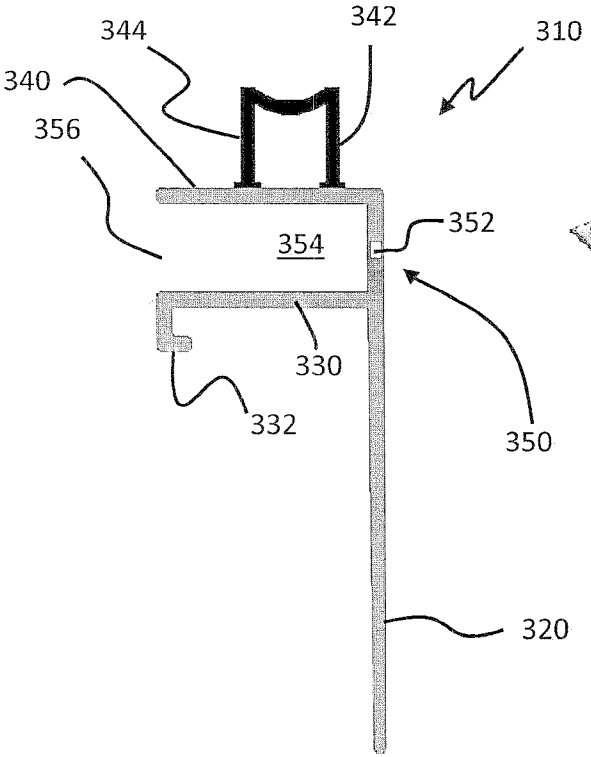

FIGS. 5A-5B are side view and isometric view illustrations of the vented stop bead apparatus 310, in accordance with a fourth exemplary embodiment of the present disclosure. The vented stop bead apparatus 310, which may be referred to herein simply as 'apparatus 310' may be substantially similar to the apparatus described relative to FIG. 1, with the exception that the apparatus 310 has an entirely open section in place of the location of the forward wall 56 of the apparatus 10 of FIG. 1. Thus, instead of having a forward wall 56 with venting structures 52 formed therein, the apparatus 310 as shown in FIGS. 5A-5B has an open forward area 356.

As shown, the apparatus 310 has a base panel 320. A stop bead wall 330 extends from the base panel 320 at a first location. A spacing member wall 340 extends from the base panel 320 at a second location. A spacing member 342 is connected to the spacing member wall 340. A vented portion 350 is positioned between the stop bead wall 330 and the spacing member wall 340, wherein the vented portion 50 has at least one venting structure 352 positioned through the base panel 320 in a position between the first and second locations.

The base panel 320 of the apparatus 310, which may be referred to as a nailing fin, may have a rear face which is applied next to a backing or nailing structure, such as plywood or particle board placed over framing studs, and a front face which faces away from the backing or nailing structure over which plaster or stucco material is applied after the apparatus 310 is mounted adjacent to the jamb. The base panel 320 may have perforations, holes, or other structures formed therein. The stop bead wall 330 extends from the base panel 320 at a first location along the base panel 320. The stop bead wall 330 may extend substantially perpendicularly from the base panel 320, or at other angular orientations, such that it is extended from the front face of the base panel 320 a predetermined distance. One side of the stop bead wall 330 may engage the stucco or plaster material applied to the front face of the base panel 320. At a distal end of the stop bead wall 330, an engaging structure 332 may be positioned, which may include a turned-back hook protrusion which creates a lip for the stucco or plaster material to contact.

At a location along the base panel 320 that differs from the location of the stop bead wall 330, the spacing member wall 340 extends from the front face of the base panel 320. The spacing member wall 340 may, in one example, be positioned substantially parallel to the stop bead wall 330. In one example, the spacing member wall 340 is positioned at a terminating end of the stop bead wall 320. The spacing member 342 formed on the spacing member wall 340 extends outwardly away from the spacing member wall 340 and the stop bead wall 330. The spacing member 342 may include a strip of flexible, resilient material, e.g., a plastic, metal, rubber, foam, or a polymer, such as flexible vinyl or a flexible exterior grade vinyl, which is capable of abutting a proximate jamb and providing a sealed connection to the jamb. The spacing member 342 may be integrally formed with the spacing member wall 340, such as by co-extrusion, or it may be a separate structure which is attached to the spacing member wall 340. For example, the spacing member 342 may include a foam or rubberized strip of material which is adhesively connected to the spacing member wall 340. The spacing member 342 may have a hollow section formed from various walls (the spacing member wall 340 being one of them), where the jamb-facing portion of the spacing member 342 has a concave design. A bond break tape 344, or similar component, may be positioned on a front face of the spacing member 342.

The vented portion 350 of the apparatus 310 is positioned between the stop bead wall 330 and the spacing member wall 340. The vented portion 350 has at least one venting structure 352 positioned through the base panel 320 in a position between the first and second locations, i.e., the locations of the stop bead wall 330 and the spacing member wall 340. In a simplistic design, for clarity, the venting portion 350 has venting structures 352, which may be holes or other protrusions, through the base panel 320, such that there can be fluid movement (gas, etc.) through the base panel 320 and to the rainscreen which is positioned behind the base panel 320 during wall construction with the apparatus 310. The venting protrusions 352 may extend along the length of the apparatus 310, or they may be positioned along specific portions of the apparatus 310.

The venting portion 350 may, in some examples, include an open interior cavity 354 which is formed by the venting structures 352 on the base panel 320 and spacing member walls 340, but without a forward wall. Unlike the apparatus 10 of FIG. 1, the forward wall may be replaced with an open forward section 356 such the interior cavity 354 is fully open to an outside atmosphere. The venting structures 352 may have a variety of designs, shapes, and/or sizes. For example, the venting structures 352 may be circular holes or holes having another shape. They may also be perforated sections of the walls formed using a puncturing or die cutting process. The size of the venting structures 352 may vary, depending on design, but they may be small enough to prevent the entrance of insects or other pests, while still allowing for air and/or fluid movement. The venting portion 350 of the apparatus 310 may allow for venting of a stucco or plastered wall, all while maintaining a seal between the apparatus 310 (and stucco or plastered wall) and the abutting jamb of a window, door, or other structure, as described relative to FIGS. 3-4.

Figure 5C:
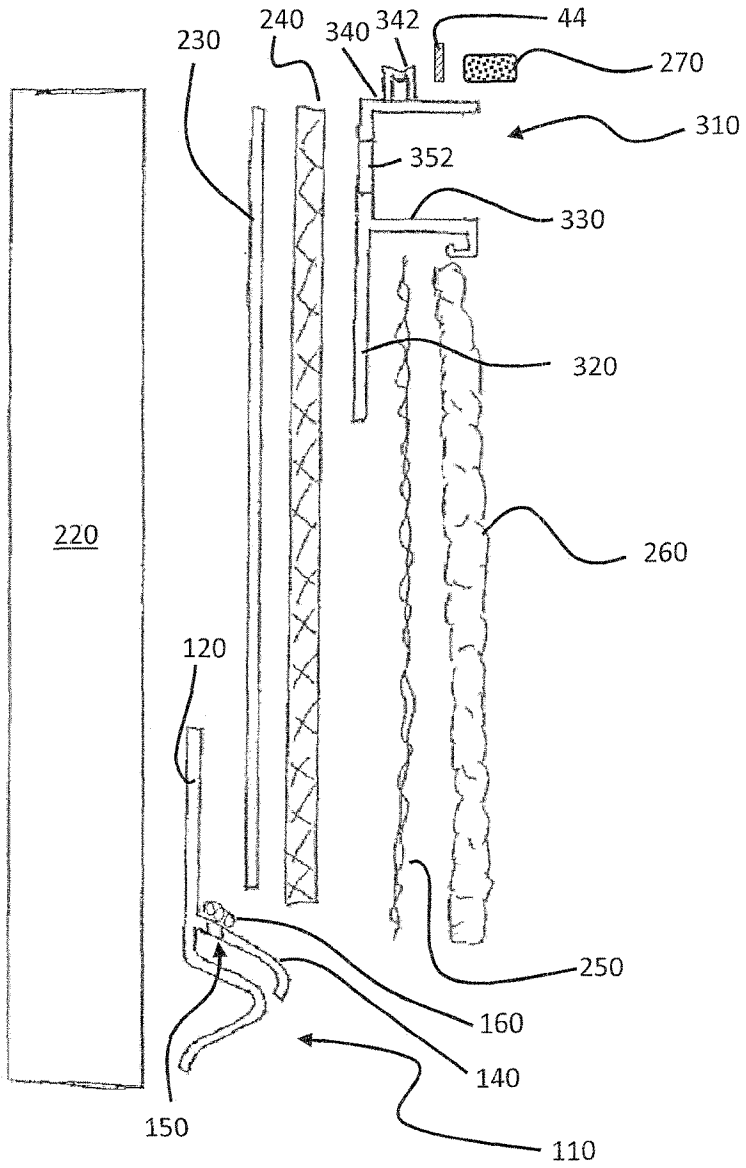
FIG. 5C is an exploded, side-view, cross-sectional illustration of the vented casing bead apparatus and the vented weep screed apparatus used in a system for venting a stucco or plaster wall, in accordance with the fourth exemplary embodiment of the present disclosure.

FIG. 5C is an exploded, side-view, cross-sectional illustration of the vented casing bead apparatus 310 and the vented weep screed apparatus 110 used in a system for venting a stucco or plaster wall, in accordance with the fourth exemplary embodiment of the present disclosure. As shown, the system for venting a stucco or plaster wall may include the use of both the vented casing bead apparatus 310 and a vented weep screed apparatus, such as the vented weep screed apparatus 110 of FIGS. 2A-2B, although it is noted that the two apparatuses 10, 110 may also be used independent of one another. The system includes a backer or nailing member 220 which may include the unfinished wall of a structure, e.g., a plywood wall anchored to wood or metal studs. The apparatus 310 may be positioned towards a top of the backer or nailing member 220 such that it is positioned towards the bottom of the wall. A vapor barrier 230 may be positioned over the backer or nailing member 220. Next, a rainscreen 240, which may also be known as a drainage mat, is positioned over the vapor barrier 230. The rainscreen 240 may provide a narrow cavity within the wall construction between the exterior cladding (stucco or plaster) and the main structure of the wall (backing or nailing member 220). The cavity created by the rainscreen 240 allows for free drainage of any water that may penetrate the stucco or plaster. The air space within the rainscreen 240 also promotes rapid drying of substrates and cladding materials, inhibiting moisture penetration into the building envelope. Further, the rainscreen 240 may ensure pressure equalization across the cavity to prevent water being drawn into the building itself.

Next, the vented casing bead apparatus 310 is positioned over the rainscreen 240 such that the venting structure 352 positioned through the base panel 320 of the apparatus 310 substantially contacts the rainscreen 240. Then, the stucco or plaster coats 260 are applied to a wire mesh 250, such as a galvanized wire mesh, which is secured to the base panel 320 of the apparatus 310 and the rainscreen 240. The coats of stucco or plaster 260 may be applied to the front edge of the apparatus 310, such that they are substantially aligned with the terminating edge of the stop bead wall 330. Caulking 270 may be applied in the cavity created between the spacing member wall 240 and the jamb (as shown in FIG. 4), and abutting the bond break tape 44 positioned against the spacing member 342.

Figure 6B:
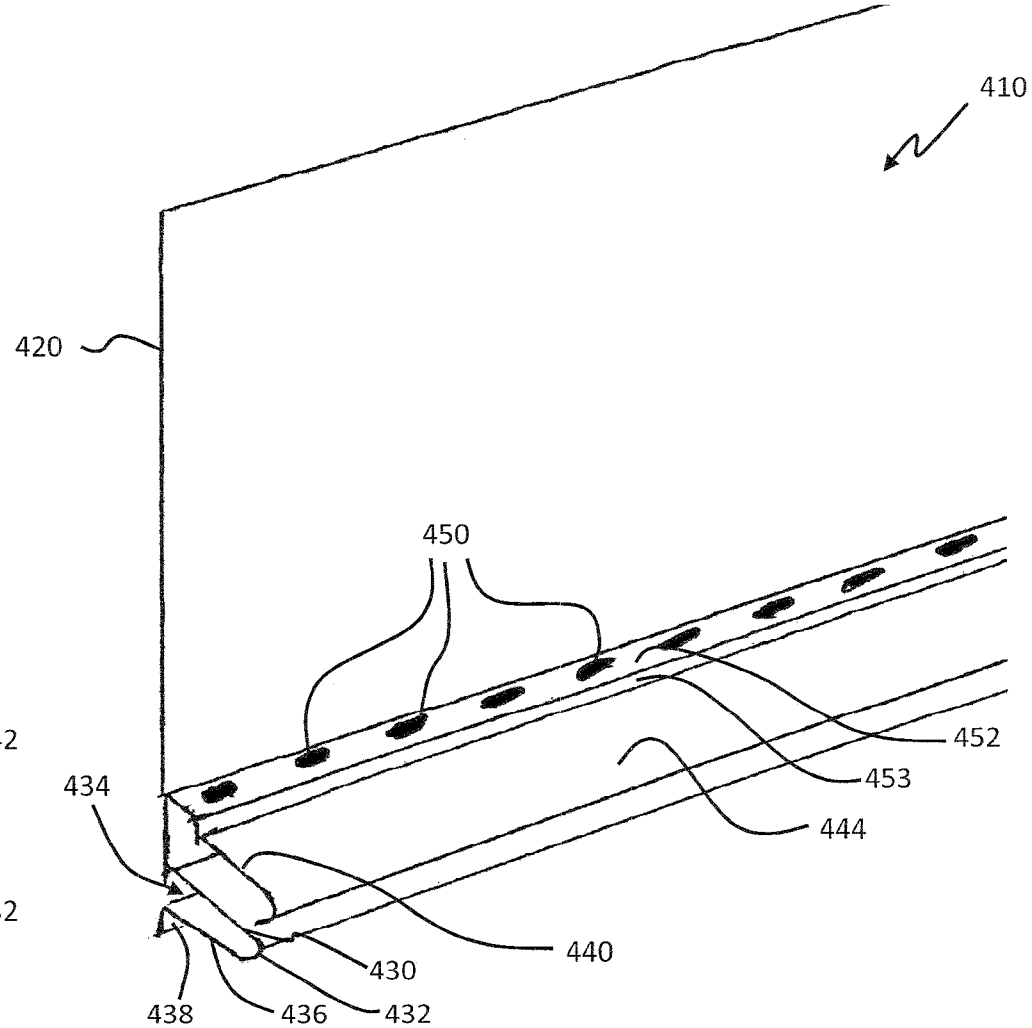
FIG. 6B is an elevated, side-view illustration of the vented weep screed apparatus, in accordance with the fifth exemplary embodiment of the present disclosure.
Figure 6A:
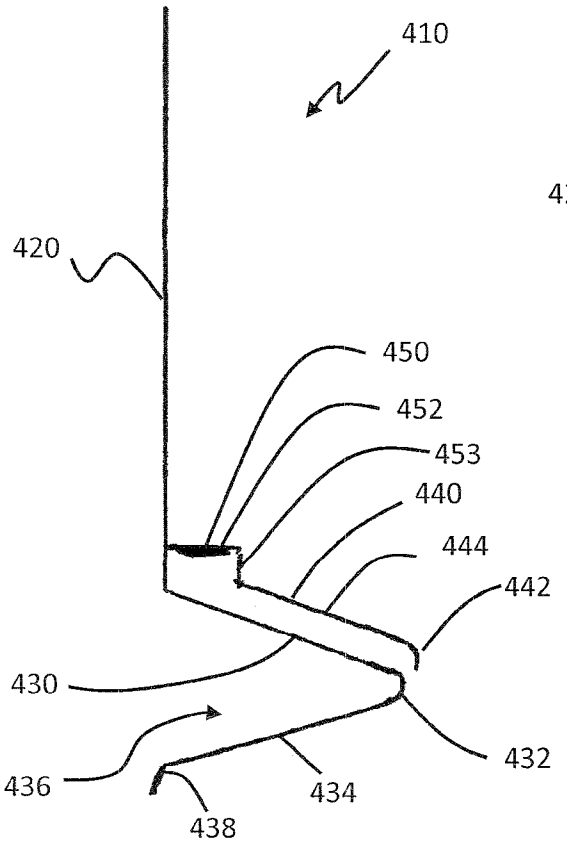
FIG. 6A is a side-view, cross-sectional illustration of a vented weep screed apparatus, in accordance with a fifth exemplary embodiment of the present disclosure.

While FIG. 5C depicts the vented weep screed apparatus 110 in accordance with the embodiment shown in FIGS. 2A-2B, a vented weep screed apparatus in accordance with the embodiments of FIG. 2C or FIGS. 6A-6B may also be used in combination with the vented casing bead apparatus 310. It is further noted that the scope of the present disclosure includes related systems which use the devices and techniques disclosed herein, including other types of wall systems or other construction techniques. Further, the scope of the present disclosure includes all related methods, processes, or functions of the apparatuses, system, and features disclosed herein.

FIGS. 6A-6B illustrate an alternative design to the vented weep screed apparatus 110 depicted in FIGS. 2A-2C, in particular, a vented weep screed design that does not use a mesh fabric or netting. Specifically, FIG. 6A is a side-view, cross-sectional illustration of a vented weep screed apparatus 410, in accordance with a fifth exemplary embodiment of the present disclosure. FIG. 6B is an elevated, side-view illustration of the vented weep screed apparatus 410, in accordance with the fifth exemplary embodiment of the present disclosure.

Relative to FIGS. 6A-6B, the vented weep screed apparatus 410, which may be referred to herein as 'apparatus 410' includes a nailing fin 420 having a front face and a rear face, where the rear face is applied next to a backing or nailing structure, such as plywood or particle board placed over framing studs, and the front face faces away from the backing or nailing structure over which plaster or stucco material is applied after the apparatus 410 is mounted to the wall. The nailing fin 420 may have perforations, holes, or other structures formed therein, such as for guiding nails or other fasteners when the apparatus 410 is applied to a wall. The apparatus 410 has at least a first leg 430 extending from the nailing fin 420 at a first location, and a second leg 440 extending from the nailing fin 420 at a second location. The first leg 430 may be positioned towards a bottom, terminating portion of the nailing fin 420, and may include a curved edge 432 which extends back towards a plane of the nailing fin 420 with a reverse leg 434, where a cavity 436 is formed between the first leg 430 and the reverse leg 434. At the end of the reverse leg 434 may be a terminating leg 438 which may extend angularly from the reverse leg 434. Other designs, shapes, and features may be included with the first leg 430 or the associated structures therewith, all of which are considered within the scope of the present disclosure.

The second leg 440 extends from the nailing fin 420 at a location that is different from the first leg 430, such as with the second leg 440 spaced a distance above the first leg 430, as depicted. The second leg 440 may be positioned substantially parallel to the first leg 430 for a portion of the second leg 440, or it may extend in a non-parallel direction relative to the first leg 430. The second leg 440 may have a terminating curved portion 442 which is positioned proximate to the curved portion 432 of the first leg 430. The terminating curved portion 442 may be positioned extended further laterally outwards past the terminating end of the first leg 430. The second leg 440 may have an upwards-facing surface 444, positioned oppositely-facing the first leg 430. On the upwards-facing surface 444, at least one venting structure 450 may be formed at a heightened position, such as on a shelf 452 which is positioned slightly above the upwards-facing surface 444, as shown, whereby a riser 453 may be connected between the shelf 452 and the second leg 440. The at least one venting structure 450 may be positioned through the second leg 440. The shelf 452 and the venting structures 450 may be positioned connected to the second leg 440 in a position close to the nailing fin 420, but where the venting structures 450 may be spaced sufficiently from the nailing fin 420. The shelf 452 may be positioned substantially perpendicular to the nailing fin 420, while the first and second legs 430, 440 are positioned in a descended angular position to the nailing fin 420. The shelf 452 may allow the venting structures 450 to be used without the need for a mesh or screening material, since the height of the venting structures 450 on the shelf 452 is capable of allowing the egress of fluids (gas, liquids, etc.) through the venting structures 450 while preventing some particulate matter, such as stucco or plaster material, from moving through the venting structures 450, or particulate matter from moving through the venting structures 450 from the bottom of the second leg 440.

The specific location of the venting structures 450 on the second leg 440 may be dependent on the wall construction (thickness of layers/materials used within the wall), and the design of the angle of the second leg 440 relative to the nailing fin 420. As shown, there may be a plurality of venting structures 450 positioned along the length of the apparatus 410. The venting structures 450 may have a variety of designs, shapes, and/or sizes. For example, the venting structures 450 may be circular holes or holes having another shape. They may also be perforated sections of the second leg 440 formed using a puncturing or die cutting process. The size of the venting structures 450 may vary, depending on design. Similarly, the precise design of the shelf 452 may vary, and may include a substantially perpendicular shape, rounded shapes, various angles, and other features.

Figure 6C:
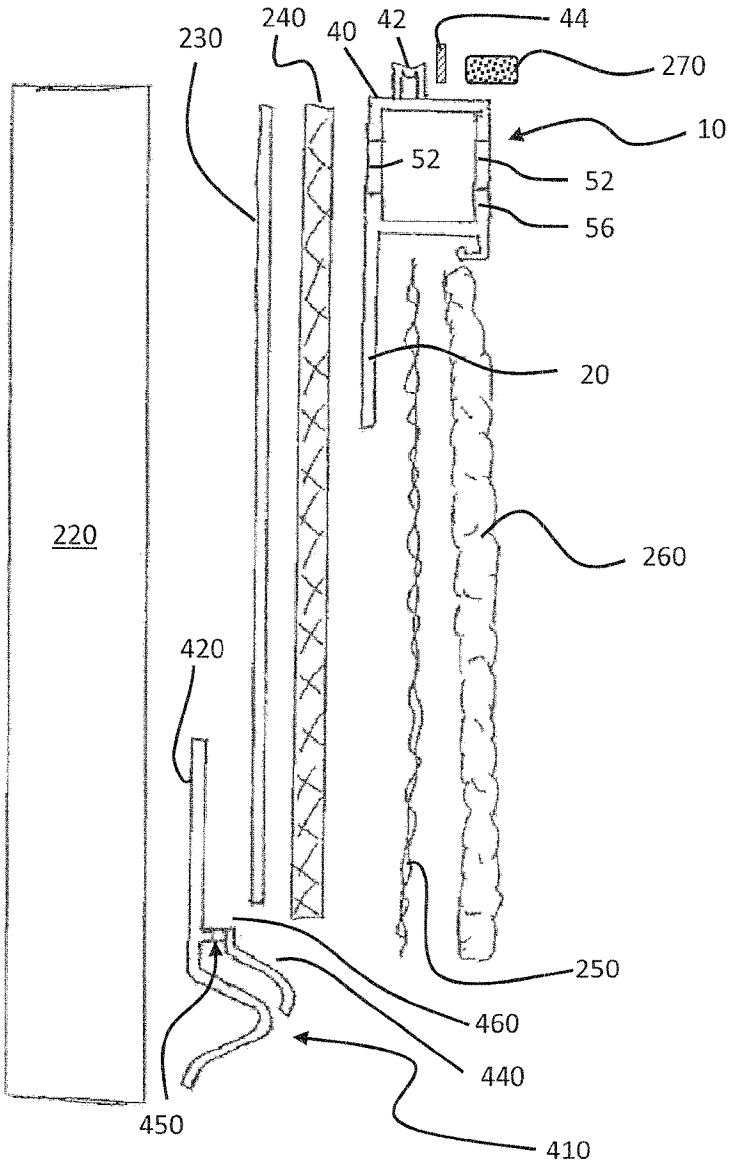
FIG. 6C is an exploded, side-view, cross-sectional illustration of the vented casing bead apparatus and the vented weep screed apparatus used in a system for venting a stucco or plaster wall, in accordance with the fifth exemplary embodiment of the present disclosure.

FIG. 6C is an exploded, side-view, cross-sectional illustration of the vented casing bead apparatus 10 and the vented weep screed apparatus 410 used in a system for venting a stucco or plaster wall, in accordance with the fifth exemplary embodiment of the present disclosure. As shown, the system may include the use of both the vented weep screed apparatus 410 and the vented casing bead apparatus 10, such as the vented casing bead apparatus 10 of FIG. 1, although it is noted that the two apparatuses 10, 410 may also be used independent of one another.

Relative to FIG. 6C, the system includes a backer or nailing member 220 which may include the unfinished wall of a structure, e.g., a plywood wall anchored to wood or metal studs. The apparatus 410 may be positioned towards a bottom of the backer or nailing member 220 such that it is positioned towards the bottom of the wall. A vapor barrier 230 may be positioned over the backer or nailing member 220 and over the nailing fin 420 of the apparatus 110. Next, a rainscreen 240, which may also be known as a drainage mat, is positioned over the vapor barrier 230. The rainscreen 240 may provide a narrow cavity within the wall construction between the exterior cladding (stucco or plaster) and the main structure of the wall (backing or nailing member 220). The cavity created by the rainscreen 240 allows for free drainage of any water that may penetrate the stucco or plaster. The air space within the rainscreen 240 also promotes rapid drying of substrates and cladding materials, inhibiting moisture penetration into the building envelope. Further, the rainscreen 240 may ensure pressure equalization across the cavity to prevent water being drawn into the building itself.

Next, a vented casing bead apparatus 10 is positioned over the rainscreen 240 such that the venting structure 52 positioned through the base panel 20 of the apparatus 10 substantially contacts the rainscreen 240. Then, the stucco or plaster coats 260 are applied to a wire mesh 250, such as a galvanized wire mesh, which is secured to the base panel 20 of the apparatus 10 and the rainscreen 240. The coats of stucco or plaster 260 may be applied to the front edge of the apparatus 10, such that they are substantially aligned with the venting structures 52 on the forward wall 56 of the apparatus 10. Caulking 270 may be applied above the venting structures 52 in the cavity created between the spacing member wall 40 and the jamb (as shown in FIG. 4), and abutting the bond break tape 44 positioned against the spacing member 42.

While FIG. 6C depicts the vented casing bead apparatus 10 in accordance with the embodiment shown in FIG. 1, a vented casing bead apparatus in accordance with the embodiments of FIGS. 5A-5C may also be used in combination with the vented weep screed apparatus 110. It is further noted that the scope of the present disclosure includes related systems which use the devices and techniques disclosed herein, including other types of wall systems or other construction techniques. Further, the scope of the present disclosure includes all related methods, processes, or functions of the apparatuses, system, and features disclosed herein.

Figure 7:
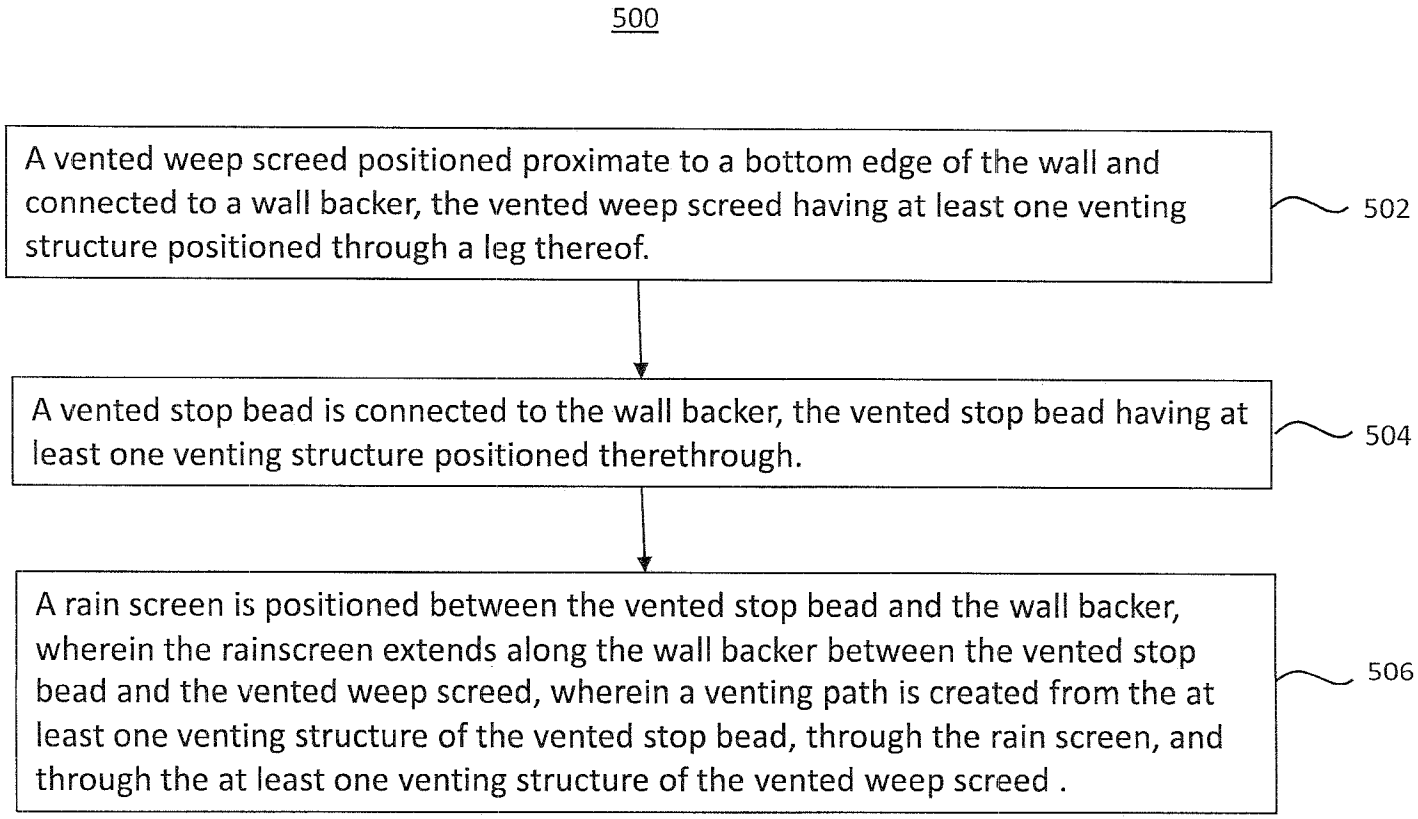
FIG. 7 is a flowchart illustrating a method of venting a stucco or a plaster wall with a vented casing bead and a vented weep screed, in accordance with a sixth exemplary embodiment of the disclosure.

FIG. 7 is a flowchart 500 illustrating a method of venting a stucco or a plaster wall with a vented casing bead and a vented weep screed, in accordance with a sixth exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 502, a vented weep screed positioned proximate to a bottom edge of the wall and connected to a wall backer, the vented weep screed having at least one venting structure positioned through a leg thereof. A vented stop bead is connected to the wall backer, the vented stop bead having at least one venting structure positioned therethrough (block 504). A rain screen is positioned between the vented stop bead and the wall backer, wherein the rainscreen extends along the wall backer between the vented stop bead and the vented weep screed, wherein a venting path is created from the at least one venting structure of the vented stop bead, through the rain screen, and through the at least one venting structure of the vented weep screed (block 506).

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A vented stop bead apparatus comprising:

a base panel;

a stop bead wall extending from the base panel;

a spacing member wall connected to the base panel, wherein a spacing member is connected to the spacing member wall;

a vented portion venting a location positioned between the stop bead wall and the spacing member wall and, wherein the vented portion has at least a first venting structure positioned through a wall of the vented portion and at least a second venting structure positioned through a plane of the base panel in a location between the stop bead wall and the spacing member wall;

an engaging structure for engagement with a plaster or stucco material, the engaging structure connected to the stop bead wall and extending away from the vented portion, wherein the engaging structure has a turned-back hook extending towards the base panel, whereby a quantity of a plaster or stucco material is positionable in a space formed between the turned-back hook and the base panel; and a nailing portion of the base panel extending from the stop bead wall away from the vented portion.

2. The vented stop bead apparatus of claim 1, wherein the at least one second venting structure further comprises a hole extending through the base panel.

3. The vented stop bead apparatus of claim 1, wherein the vented portion further comprises an interior cavity formed between the stop bead wall, the spacing member wall, and the wall, wherein the forward wall is positioned proximate to at least one of the stop bead wall and the spacing member wall.

4. A vented weep screed apparatus comprising:

a nailing fin having first and second sides;

a first leg having a first leg portion extending from the first side of the nailing fin at a first location, wherein the first leg has a reverse leg portion extending back towards a plane of the nailing fin, wherein the reverse leg portion terminates at a position aligned with the plane of the nailing fin or past a plane of the second side of the nailing fin; and a second leg extending from the nailing fin at a second location, the second leg comprising a shelf connected to an upwards-facing surface by a riser, wherein the shelf is connected to a first edge of the riser and the upwards-facing surface is connected to a second portion of the riser, wherein the shelf is positioned vertically above the upwards-facing surface by the riser, and wherein the upwards-facing surface has a continuous downwards slope; and at least one venting structure positioned through the shelf of the second leg.

5. The vented weep screed apparatus of claim 4, wherein the at least one venting structure is positioned vertically above the first leg.

6. The vented weep screed apparatus of claim 4, wherein the shelf is positioned substantially perpendicular to a plane of the nailing fin.

7. The vented weep screed apparatus of claim 4, wherein the second leg extends laterally outwards past a curved edge of the first leg portion of the first leg, wherein the curved edge is positioned at a laterally outermost position of the first leg.

8. A system for venting a wall formed of at least one of stucco and plaster, the system comprising:

a vented weep screed positioned proximate to a bottom edge of the wall and connected to a wall backer, the vented weep screed having at least one venting structure positioned through a leg thereof;

a vented stop bead connected to the wall backer and positioned proximate to a top edge of the wall, the vented stop bead having at least one stop bead venting structure positioned therethrough; and a rain screen positioned between the vented stop bead and the wall backer, wherein the rain screen extends along the wall backer between the vented stop bead and the vented weep screed, wherein a venting path is created from the at least one stop bead venting structure of the vented stop bead, through the rain screen, and through the at least one venting structure of the vented weep screed.

9. The system of claim 8, wherein the vented weep screed further comprises a first leg extending from a nailing fin at a first location and a second leg extending from the nailing fin at a second location, the second leg comprising a shelf connected to an upwards-facing surface by a riser, wherein the shelf is connected to a first edge of the riser and the upwards-facing surface is connected to a second portion of the riser, wherein the shelf is positioned vertically above the upwards-facing surface by the riser, and wherein the at least one venting structure is formed through the shelf of the second leg.

10. The system of claim 9, wherein the shelf is positioned substantially perpendicular to a plane of the nailing fin.

11. The system of claim 8, wherein the at least one stop bead venting structure of the vented stop bead is positioned within a vented portion formed between a stop bead wall and a spacing member wall, wherein an interior cavity is formed therebetween.

12. The system of claim 11, further comprising a forward wall to the interior cavity, wherein the forward wall is connected between the stop bead wall and the spacing member wall.

13. The system of claim 8, wherein the vented stop bead is positioned vertically above the vented weep screed.

14. The vented weep screed apparatus of claim 4, further comprising a curved edge positioned between the first leg portion and the reverse leg portion, wherein a plane of the first leg portion forms an acute angle with a plane of the reverse leg portion.

15. The vented weep screed apparatus of claim 14, wherein the reverse leg portion terminates with a terminating leg extending angularly from the reverse leg portion.

16. The vented weep screed apparatus of claim 4, wherein the upwards-facing surface terminates in a curved portion.

17. The system of claim 9, wherein the first leg of the vented weep screed apparatus further comprises a reverse leg extending back towards a plane of the nailing fin.

18. The system of claim 17, wherein the reverse leg terminates with a terminating leg extending angularly from the reverse leg.

19. The vented weep screed apparatus of claim 9, wherein the upwards-facing surface terminates in a curved portion.

* * * * *